US007740511B2

(12) United States Patent
Katano

(10) Patent No.: US 7,740,511 B2
(45) Date of Patent: Jun. 22, 2010

(54) ELECTRICAL CONTACT AND ELECTRICAL CONNECTOR USING THE SAME

(75) Inventor: Tetsuya Katano, Atsugi (JP)

(73) Assignee: Tyco Electronics Japan G.K., Kanagawa-Ken (JP)

( * ) Notice: Subject to any disclaimer, the term of this patent is extended or adjusted under 35 U.S.C. 154(b) by 0 days.

(21) Appl. No.: 11/871,232

(22) Filed: Oct. 12, 2007

(65) Prior Publication Data

US 2008/0090473 A1 Apr. 17, 2008

(30) Foreign Application Priority Data

Oct. 13, 2006 (JP) ..... 2006-280208

(51) Int. Cl.
*H01R 11/22* (2006.01)

(52) U.S. Cl. ..... 439/816

(58) Field of Classification Search ..... 439/816, 439/856–857, 748

See application file for complete search history.

(56) References Cited

U.S. PATENT DOCUMENTS 5,611,717 A * 3/1997 Joly ..... 439/857
5,655,935 A * 8/1997 Yoshimura ..... 439/748
6,478,637 B1 * 11/2002 Ohkita et al. ..... 439/857
6,634,911 B1 * 10/2003 Billman et al. ..... 439/884
7,044,811 B2 * 5/2006 Chritz et al. ..... 439/856
2006/0030191 A1 * 2/2006 Tuin et al. ..... 439/246

FOREIGN PATENT DOCUMENTS

JP 2006019296 1/2006

* cited by examiner

*Primary Examiner*—Edwin A. Leon
*Assistant Examiner*—Vanessa Girardi
(74) *Attorney, Agent, or Firm*—Barley Snyder LLC

(57) ABSTRACT

A contact having a support, a first arm supported by the support and configured to contact a mating contact, and a second arm facing the first arm in a facing direction and supported by the support and configured to contact the mating contact is disclosed. A first spring and a second spring are each connected to the support and bent in the facing direction and extend along a plane substantially perpendicular to the facing direction. The first spring and the second spring elastically support the support in the facing direction and a mount is connected to the first spring and the second spring.

20 Claims, 11 Drawing Sheets

ELECTRICAL CONTACT AND ELECTRICAL CONNECTOR USING THE SAME

CROSS-REFERENCE TO RELATED APPLICATION DATA

This application claims the benefit of the earlier filed parent patent application document JP Patent Application No. 2006-280208 having a filing date of Oct. 13, 2006.

FIELD OF THE INVENTION

The present invention relates to an electrical contact and to an electrical connector.

BACKGROUND

A known example of such a contact is disclosed in Japanese Patent Application Laid-open Publication No. 2006-19296. A contact section of the disclosed type of contact includes a spring section for pinching a mating contact to maintain a contacting state even when the mating contact moves relative to the contact.

Prior Art FIGS. 11A-11E show a contact according to a conventional technique which is illustrated together with manufacturing processes of the contact. Prior Art FIG. 11E shows the contact in a finished state, while Prior Art FIGS. 11A-11D sequentially show the manufacturing processes of the contact illustrated in Prior Art FIG. 11E. Here, the sequence of processes shown in Prior Art FIGS. 11A-11D is merely an example, and it is still possible to manufacture the contact shown in Prior Art FIG. 11E even in a different sequence of processes from those shown in Prior Art FIGS. 11A-11D.

A contact 900 according to the conventional technique is shown in Prior Art FIG. 11E. The contact 900 includes a U-shaped contact section 901, a pair of leg sections 902 to be brought into contact with a circuit board, and a pair of plate-like spring sections 904 which extend respectively from a pair of free-ends 903 provided on the contact section 901 toward the leg sections 902 while being bent at an angle of 180° in two positions along the way. The leg sections 902 are connected to the circuit board (not shown) by solder, and the U-shaped contact section 901 pinches a mating contact to establish electrical connection therewith. The contact 900 enables the contact 901 supported by the spring sections 904 to follow movements of the mating contact even when the mating contact receives an external force and moves in a direction in which the two free-ends 903 face each other.

The contact 900 is manufactured by punching and bending a conductive metal plate. To manufacture the contact 900, first a contact form 920 shown in Prior Art FIG. 11A is obtained by punching the metal plate. Although it is not illustrated in the drawing, the contact form 920 is connected with a lead frame that is formed together with the contact form 920 in the punching process. Next, this contact form 920 is bent along lines A, B, C, and D. To be more precise, two positions are bent at an angle of 90° along the line A (see Prior Art FIG. 11B) and then two positions are bent at an angle of 180° along the line B (see Prior Art FIG. 11C). Further, two positions are bent at an angle of 180° along the line C (see Prior Art FIG. 11D), and finally, two positions are bent at an angle of 90° along the line D to obtain the contact 900 shown in Prior Art FIG. 11E.

In the contact 900, it is necessary to bend the form at least six times along the lines A, B, and C in order to form the structure that allows the contact section 901 to pinch the mating contact and move so as to follow the movement of the mating contact. Moreover, it is necessary to bend the form four times along the line B and the line C at an angle of 180°, which requires more complicated processes than bending the form at the angle of 90°. Accordingly, the productivity of manufacturing the contact 900 is low.

Further, in the contact 900 according to the conventional technique shown in Prior Art FIGS. 11A-11E, the two free-ends 903 are to be located on both sides of the mating contact are directly connected to the different spring sections 904. Therefore, if vibration or impact is applied to the mating contact, a gap may be momentarily caused between the two free-ends 903 and the mating contact, which may result in breaking electrical connection therewith.

Further, the two free ends 903 that are to be located on both sides of the mating contact are directly connected to the different spring sections 904, respectively. Therefore, when vibration or an impact is applied to the mating contact, one of the two free ends 903 cannot follow the movement of the other one. Accordingly, a clearance may be momentarily generated between the two free ends 903 and the mating contact may be electrically disconnected from the conventional contact 900.

Still further, the contact according to the conventional technique shown in Prior Art FIGS. 11A-11E include the parts to be soldered in two positions and the parts are placed on the tip ends of the slender leg sections 902. Therefore, when connecting this contact by soldering, it is difficult to secure positional accuracy on the conductive part of the circuit board.

SUMMARY

The present invention relates to a contact having a support, a first arm supported by the support and configured to contact a mating contact, and a second arm facing the first arm in a facing direction and supported by the support and configured to contact the mating contact. A first spring and a second spring are each connected to the support and bent in the facing direction and extend along a plane substantially perpendicular to the facing direction. The first spring and the second spring elastically support the support in the facing direction and a mount is connected to the first spring and the second spring.

BRIEF DESCRIPTION OF THE DRAWINGS

Prior Art

Prior Art

Prior Art

Prior Art

DETAILED DESCRIPTION OF THE EMBODIMENTS

Figure 1A:
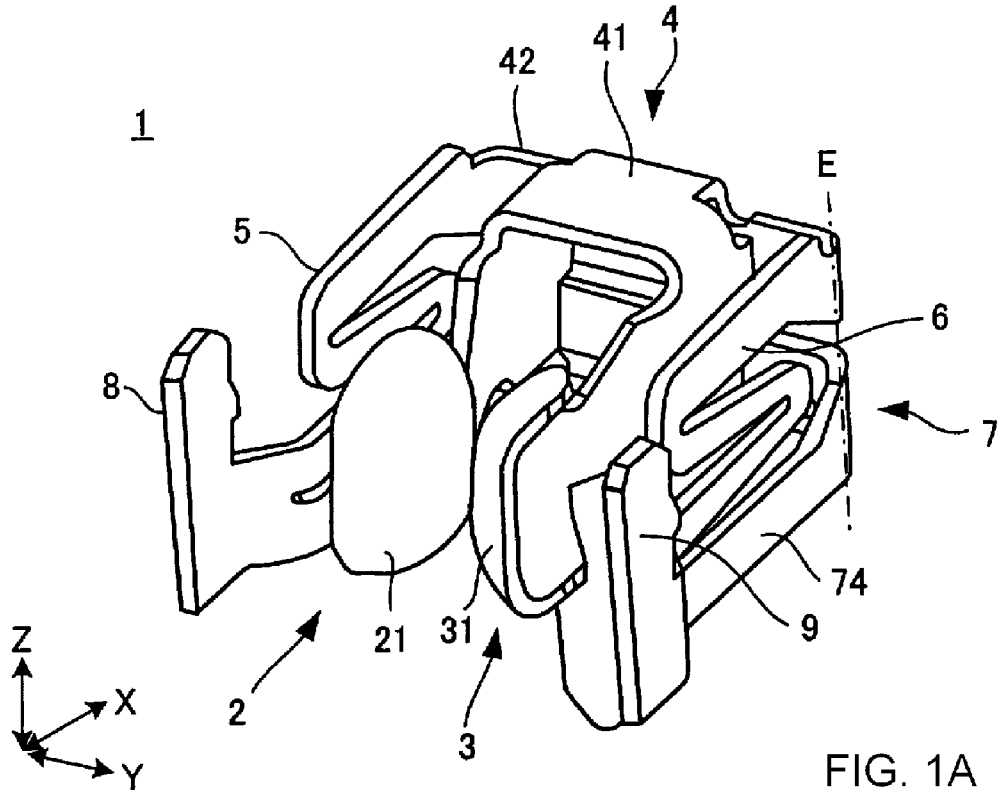
FIG. 1A is a perspective view of a contact according to a first embodiment of the present invention.
Figure 1B:
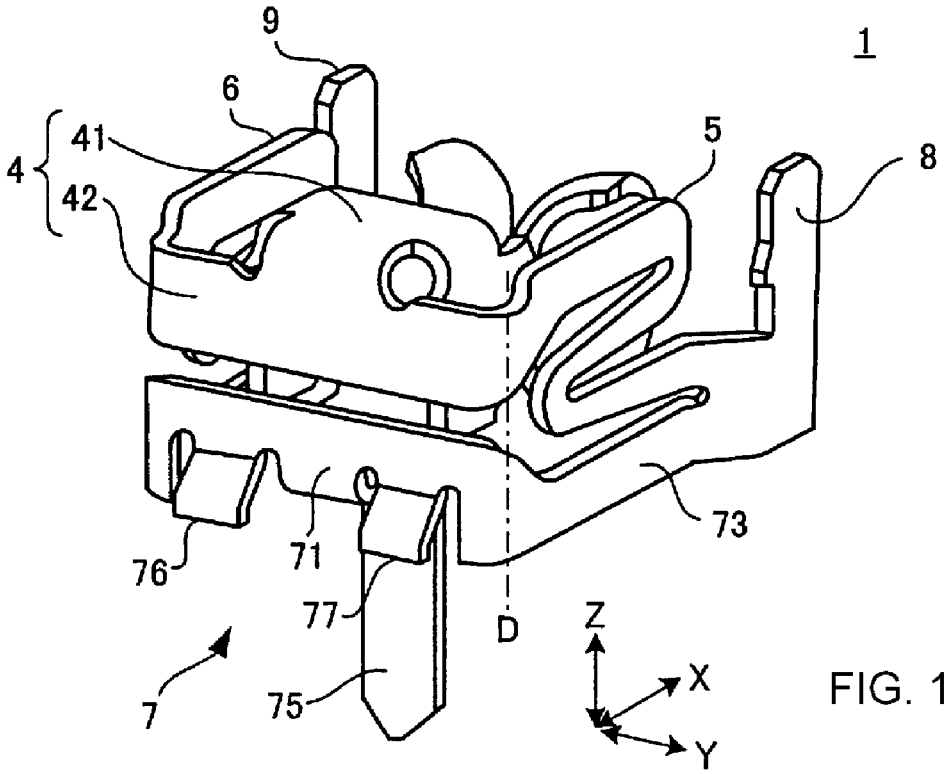
FIG. 1B is another a perspective view of the contact of FIG. 1A.
Figure 2A:
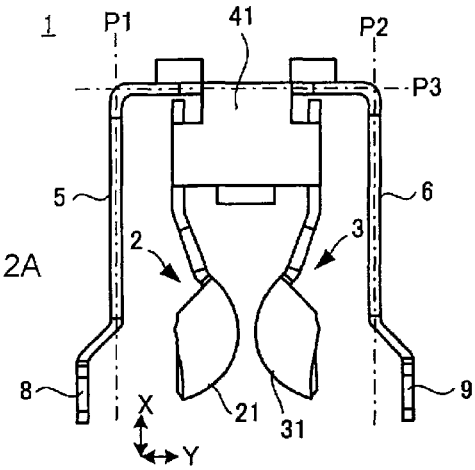
FIG. 2A is a perspective view of the contact of FIG. 1A.
Figure 2D:
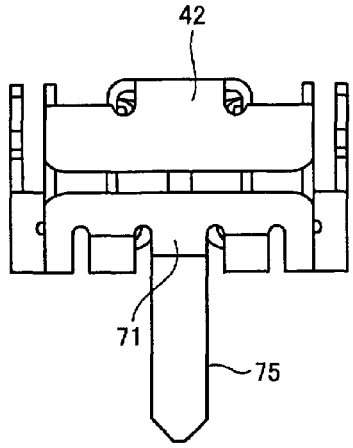
FIG. 2D is another perspective view of the contact of FIG. 1A.
Figure 2B:
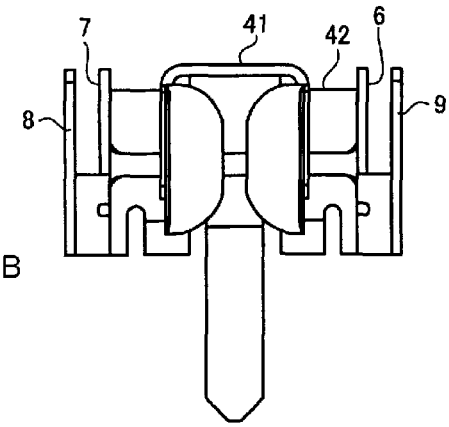
FIG. 2B is another perspective view of the contact of FIG. 1A.
Figure 2E:
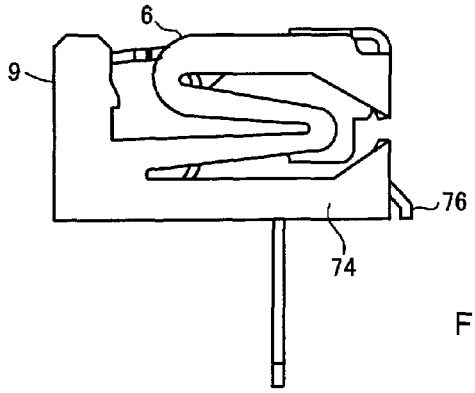
FIG. 2E is another perspective view of the contact of FIG. 1A.
Figure 2C:
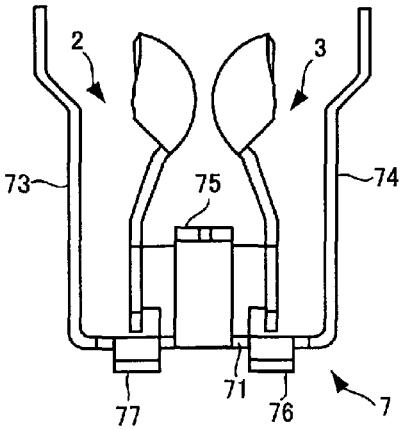
FIG. 2C is another perspective view of the contact of FIG. 1A.

Embodiments of a contact and an electrical connector of the present invention will be described below with reference to the accompanying drawings.

FIGS. 1A-2E illustrate a contact according to a first embodiment of the present invention. In one application, contact 1 is mechanically attached to and electrically connected to a conducting part of a circuit board such as a printed circuit board provided with a conducting pattern. Contact 1 may also contact a mating contact (discussed infra) to establish electrical connection therewith. The contact 1 comprises a first arm 2, a second arm 3, and a support 4 that supports the first arm 2 and the second arm 3. The contact 1 further comprises a first spring 5 and a second spring 6 that are each bent to extend from both ends of the support 4 in a facing direction Y of the first arm 2 and second arm 3. Still further, the contact 1 comprises a mount 7 that joins respective ends of the first spring 5 and the second spring 6 on the opposite side of the support 4. The contact 1 also comprises a first tab 8 and a second tab 9 joined to both ends of the mount 7. The contact 1 may be manufactured by punching and bending a metal plate so that the first arm 2, second arm 3, support 4, first spring 5, second spring 6, mount 7, first tab 8, and second tab 9 are integrally formed. In one embodiment, a highly-elastic thin plate such as a copper alloy is used as the metal plate. The direction in which the first arm 2 and a second arm 3 extend is defined as an anteroposterior direction X, while the direction substantially perpendicular to both of the anteroposterior direction X and the facing direction Y is defined as a vertical direction Z.

The first arm 2 and second arm 3 face each other. A first connection pad 21 is provided on the first arm 2 while a second connection pad 31 is provided on the second arm 3. The first connection pad 21 and second connection pad 31 each comprise a generally spherical contour. The support 4 comprises an arm joint 41 that joins the first arm 2 with the second arm 3 and a support plate 42 that is joined to the arm joint 41 and is provided substantially perpendicular to the arm joint 41. The first arm 2 and second arm 3 are bent on both ends in the facing direction Y of the arm joint 41 and extended in the anteroposterior direction X. The first arm 2 and second arm 3 are arranged such that a clearance between the first connection pad 21 and the second connection pad 31 is narrower than a thickness of the mating contact (discussed infra). When the plate-like mating contact is inserted into the space between the first arm 2 and second arm 3, first arm 2 and second arm 3 are elastically deformed so that the first connection pad 21 and second connection pad 31 pinch the mating contact from both sides in the facing direction Y.

The first spring 5 and second spring 6 are bent on both ends in the facing direction Y of the support 4 at an angle of 90° and extend along XZ planes P1 and P2 (see FIG. 2A) which are substantially perpendicular to the facing direction Y. Ends of the first spring 5 and second spring 6 on the opposite side of the support 4 are joined to the mount 7. To be more precise, each of the first spring 5 and second spring 6 has a shape of a plate disposed along the XZ planes P1 and P2 substantially perpendicular to the facing direction Y, which is cut out into a meandering shape extending in the anteroposterior direction X. The first spring 5 and second spring 6 are formed into the meandering shapes within the XZ planes P1 and P2. The meandering shapes of the first spring 5 and second spring 6 increase a range of displacement of the first arm 2 and second arm 3, respectively. Because the first spring 5 and second spring 6 are formed into the meandering shape, it is possible to increase a range at which the first arm 2 and second arm 3 are capable of moving while following the movement of the mating contact with a limited space as compared to a case of joining the support 4 and the mount 7 linearly. Accordingly, it is possible to further reduce a risk of disconnecting electrical connection at the time of an impact.

The mount 7 is mechanically attached to the conducting part of the circuit board and is electrically connected to this conducting part. The mount 7 includes a base 71 disposed along a YZ plane P3 (see FIG. 2A) common to the support plate 42, and a first wing 73 and second wing 74 which are bent perpendicularly and extended forward from both ends of the base 71 in the facing direction Y and are joined to the first spring 5 and second spring 6. The first wing 73, the base 71, and the second wing 74 of the mount 7 collectively join a space between the first spring 5 and second spring 6, thereby providing the contact 1 with a closed annular structure formed of the support 4, the first spring 5, the second spring 6, and the mount 7. Meanwhile, a solder leg 75 that extends in the vertical direction Z and is connected to a circuit board 303 (see FIG. 9) by soldering is provided at the central part in the facing direction Y of the base 71. As the solder leg 75 is provided on the mount 4 that joins the first spring 5 and second spring 6, both of the springs 5, 6 are supported by the circuit board via the mount 4 by soldering in a single position. Therefore, it is possible to improve productivity in the course of attachment to the circuit board in comparison with a pair of spring sections that are individually connected to the circuit board by soldering. First stop 76 and second stop 77 are formed on both sides of the center in the facing direction Y. The joint sections between both ends of the base 71 in the facing direction Y and the first wing 73 and second wing 74 are aligned with the bending lines D and E where the first spring 5 and second spring 6 are bent from both ends of the support 4. In other words, first wing 73 and second wing 74 are bent from both ends of the base section 71 along bending lines D and E. It will be appreciated that the position where the solder leg 75 is provided is not limited to the central part of the base section 71, but rather, may be changed as necessary according to conditions in which the contact 1 is used.

The first tab 8 and second tab 9 are formed of protrusions extending upward from locations of the first wing 73 and second wing 74 joined to the first spring 5 and second spring 6, and are secured to a cover for protecting the contact 1 by press-fitting. The parts of the first wing 73 and second wing 74 are respectively joined to the first tab 8 and second tab 9 are bent in two positions according to a space in which the contact 1 is housed.

The contact 1 movably supports the support 4 together with the first arm 2 and second arm 3 in the facing direction Y by elastic deformation of the first spring 5 and second spring 6. Therefore, when the mating contact is moved in the facing direction Y by an external force while the contact 1 pinches the mating contact with the first arm 2 and second arm 3, the first spring 5 and second spring 6 are elastically deformed and the first arm 2 and second arm 3 move together with the support 4 so as to follow the movement of the mating contact.

Contact 1 has the structure in which the first arm 2 and second arm 3 are both connected to the support 4 while the first spring 5 and second spring 6 are also connected to the support 4. Accordingly, the first arm 2 and second arm 3 move integrally with the support 4 and are supported by the first spring 5 and second spring 6. Thus, when an impact is applied to the contact 1, the first arm 2 and second arm 3 continue to pinch a mating contact 331 without disconnection, and electrical connection is preserved.

Next, a process of manufacturing the contact 1 will be described.

Figure 3:
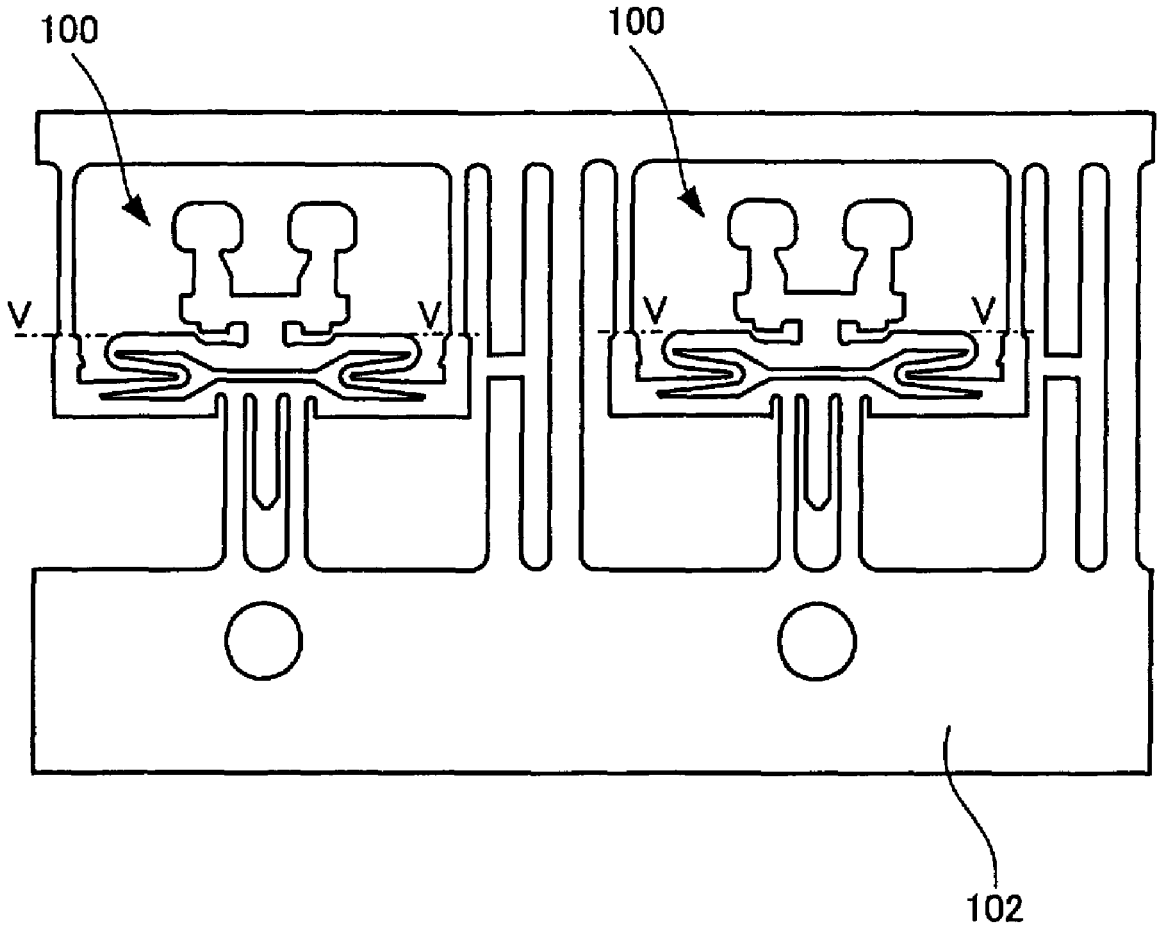
FIG. 3 is an orthogonal view of a contact form in an initial state immediately after punching process of manufacturing the contact of FIG. 1A.

FIG. 3 is a view showing a state immediately after punching a metal plate in the process of manufacturing the contact 1 shown in FIG. 1A.

The contact 1 is manufactured by punching and bending a conductive metal plate. As shown in FIG. 3, multiple unbent contact forms 100 to be ultimately formed into the contacts 1 are formed in the punching process in a previous step of the bending process. In the punching process, a lead frame 102 in the shape of connecting multiple frame bodies in a tape fashion is formed at the same time. The contact forms 100 are arranged while joined to the lead frame 102. The contact forms 100 are then cut out along a line V and bent while being joined to the lead frame 102 in the sections that are to be the first stop 76 and second stop 77 (see FIG. 1B), and then formed to be in the state shown in FIG. 5.

Figure 4A:
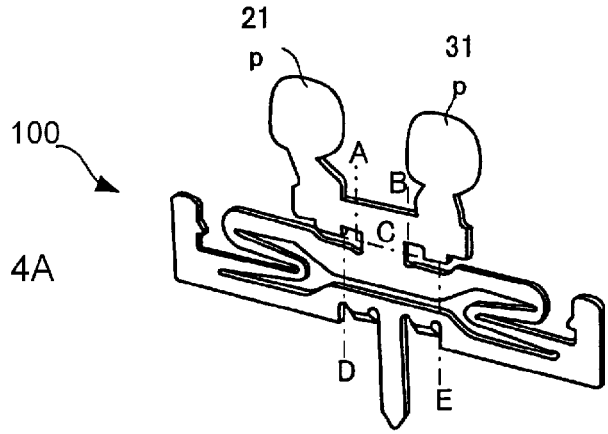
FIG. 4A is a perspective view of the contact form of FIG. 3 showing the contact form removed from the punched material.
Figure 4B:
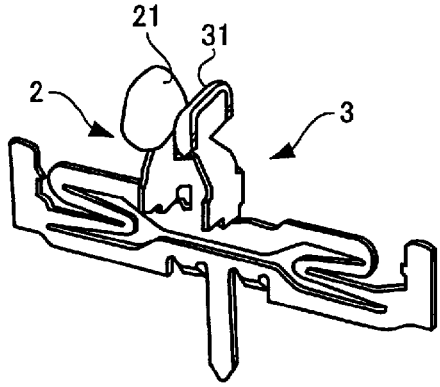
FIG. 4B is a perspective view of the contact form of FIG. 4A after a first set of bending processes.

FIGS. 4A-4E sequentially show the bending process of a single piece of the contact form 100. The lead frame 102 shown in FIG. 3 is omitted in FIGS. 4A-4E. The contact form 100 shown in FIG. 4A is bent mainly along respective lines from a line A to line E.

First, first connection pad end 21*p* and second connection pad end 31*p* of the contact form 100 shown in FIG. 4A are bent into spherical shapes to form the first connection pad 21 and second connection pad 31 of the contact 1. Meanwhile, the first arm 2 and second arm 3 are formed by bending the contact form 100 at an angle of 90° along the line A and the line B (see FIG. 4B).

Figure 4C:
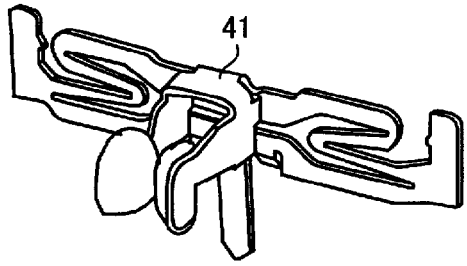
FIG. 4C is a perspective view of the contact form of FIG. 4B after a subsequent set of bending processes.

Next, the contact form 100 is bent at angle of 90° along the line C to form the arm joint 41 (see FIG. 4C).

Figure 4D:
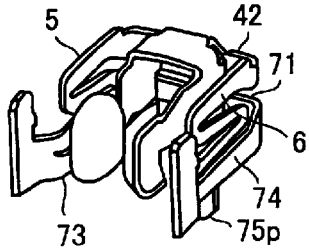
FIG. 4D is a perspective view of the contact form of FIG. 4C after another subsequent set of bending processes.
Figure 4E:
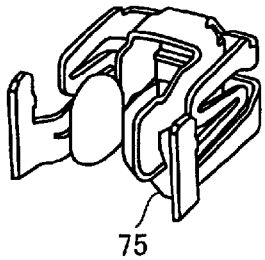
FIG. 4E is a perspective view of the contact form of FIG. 4D after another set of subsequent bending processes.

Next, the contact form 100 is bent at an angle of 90° along the line D and the line E to form the support plate 42, the first spring 5 and second spring 6, the base section 71, and the first wing 73 and second wing 74 (see FIG. 4D). When necessary, the joint sections of the first tab 8 and second tab 9 with the first wing 73 and second wing 74 are bent to widen a clearance between the first tab 8 and second tab 9.

Next, the solder leg 75 is formed by bending a lower end 75*p*.

Figure 5:
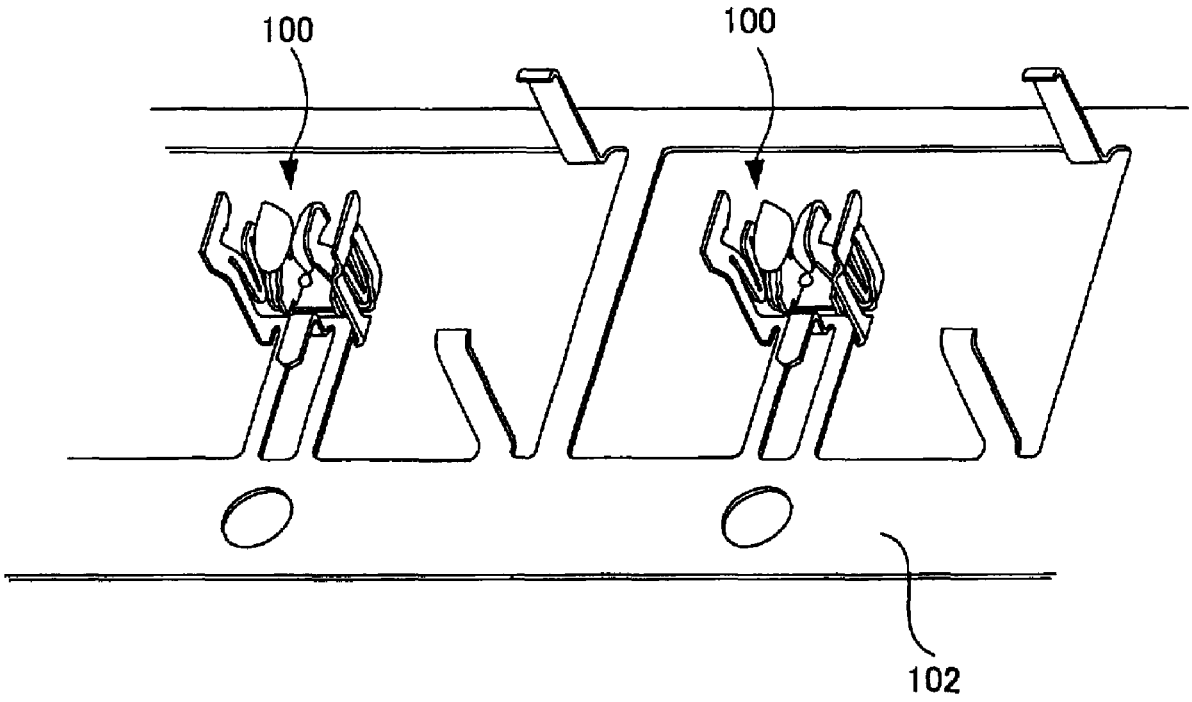
FIG. 5 is a perspective view of the contact form of FIG. 3 after being bent and while still attached to a lead frame.

FIG. 5 is a perspective view of the contact form 100 illustrated together with the lead frame 102 after undergoing the bending process. Finally, the contact 1 shown in FIG. 1 is finished by cutting the contact form 100 shown in FIG. 5 out of the lead frame 102. Here, the contact 1 can be also manufactured by a different bending sequence of processes shown from FIGS. 4A-4E.

In the contact 1 shown in FIG. 1A, the structure to allow the first arm 2 and second arm 3 to pinch the mating contact from both sides in the facing direction Y can be obtained by bending the contact form 100 once at an angle of 90° along the line A and once again at an angle of 90° along the line B. Meanwhile, in the contact 1, the structure to support the first arm 2 and second arm 3 by the first spring 5 and second spring 6 (which are bent from the support 4 and extended along the XZ planes P1 and P2 that are substantially perpendicular to the facing direction Y) can be obtained by bending the contact form 100 once at an angle of 90° along the line D and once again at an angle of 90° along the line E. The above-described bending is simpler than bending at an angle of 180° and therefore the contact 1 can be produced with increased productivity. It is important to note that the substantially perpendicular first spring 5 and second spring 6 are not limited only to a state in which the plane that the springs 5, 6 extend is strictly perpendicular to the facing direction Y, but also includes a state in which the plane is approximately perpendicular to the facing direction Y to allow the first arm 2 and second arm 3 to move while following the movement of the mating contact in the facing direction Y. Moreover, it is also possible to simultaneously obtain the structure that the mount 7 includes the base section 71 provided on the same plane as the support plate 42 while the first wing 73 and second wing 74 are provided on the same planes as those of the first spring 5 and second spring 6 so as to join the first spring 5 and second spring 6.

Next, a second embodiment of the present invention will be described.

Figure 6A:
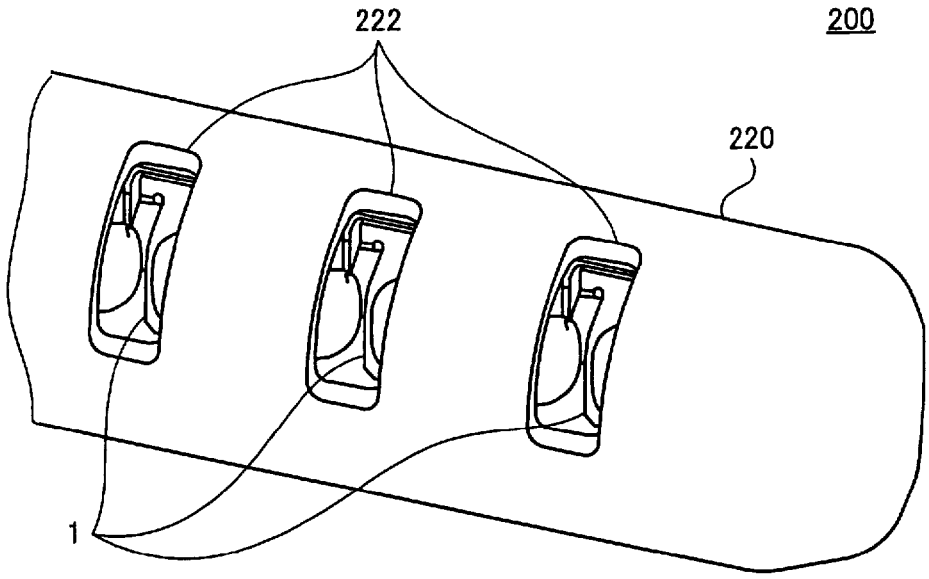
FIG. 6A is a perspective view of a connector according to another embodiment of the present invention.
Figure 6B:
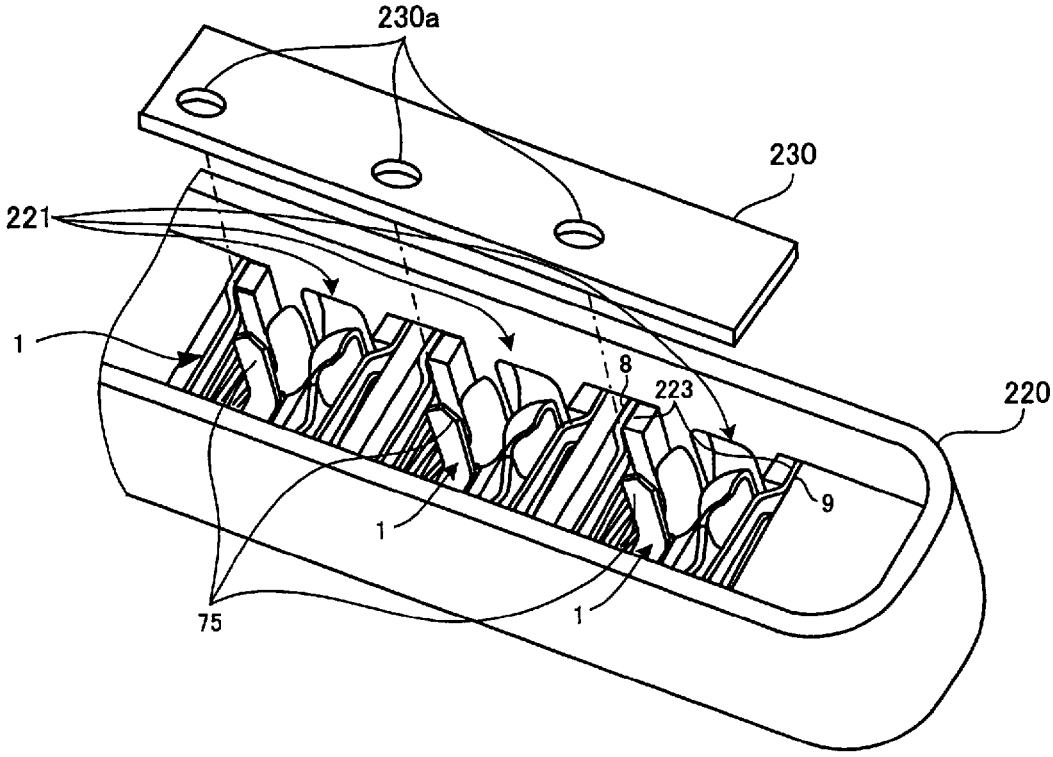
FIG. 6B is another perspective view of the connector of FIG. 6A.

FIG. 6 is a perspective view showing an appearance of an electrical connector according to the second embodiment of the present invention. FIG. 6A shows an electrical connector 200 (the electrical connector will be hereinafter simply referred to as a connector) which is viewed from a side to be brought into contact with the mating connector, and FIG. 6B shows the connector 200 from which a circuit board 230 is detached, viewed from the opposite side of FIG. 6A. Meanwhile, FIG. 7 is a perspective view showing an appearance of the mating connector.

Figure 7:
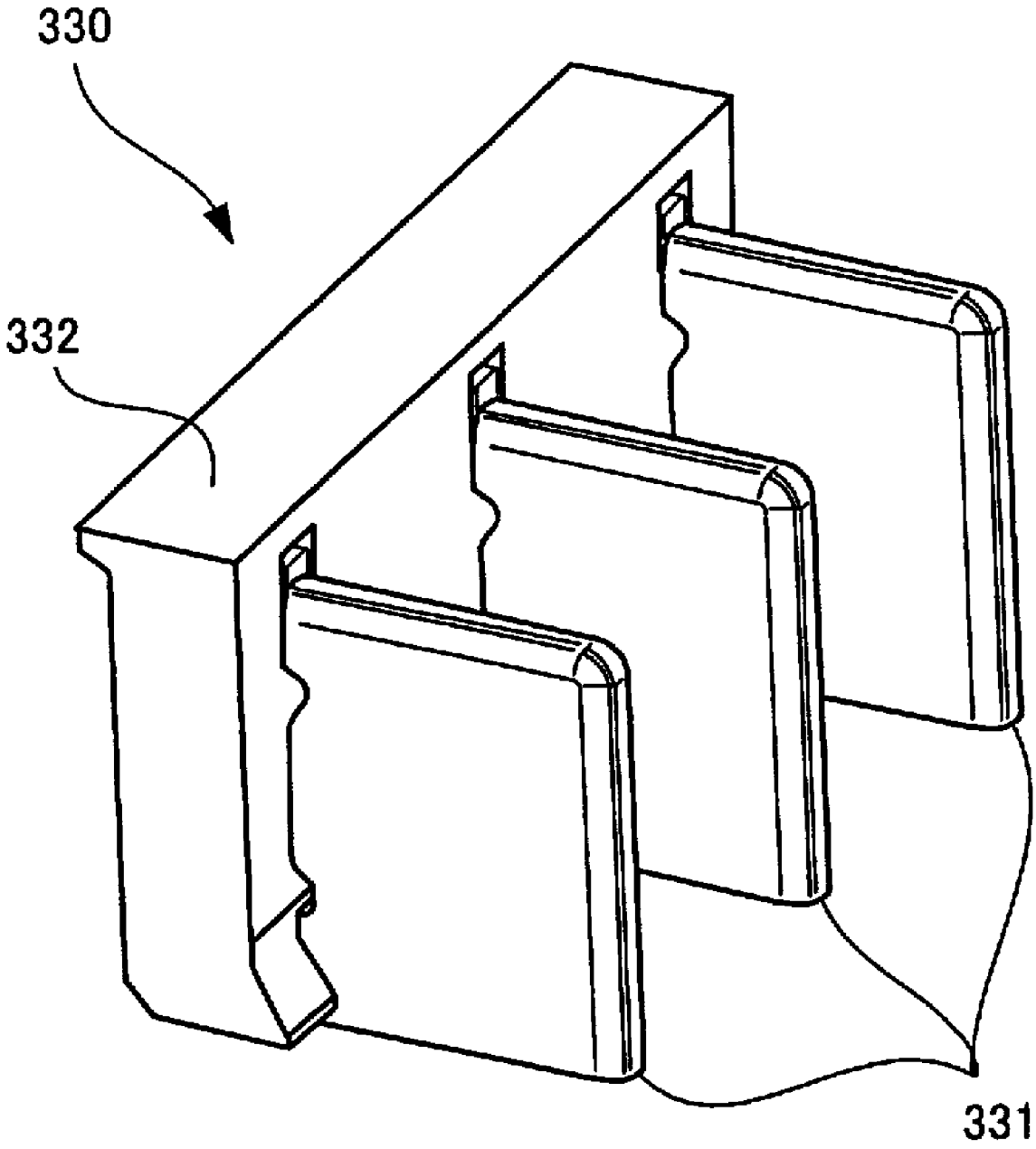
FIG. 7 is a perspective view of a mating connector.

The connector 200 is a component to which the mating connector 330 in FIG. 7 is connected and includes three contacts 1 described in the first embodiment and a dome-shaped cover 220 that encloses and protects the contacts 1. In this embodiment, the connector 200 is used for a thin-profile battery unit that is to be attached to the inside of a cellular telephone. The connector 200 is to be connected to a circuit board in a thin-profile battery unit by soldering and is used as a connector to be connected with the mating connector 330 (see FIG. 7) provided on the cellular telephone. The cover 220 constitutes part of a casing of the battery unit.

The mating connector 330 shown in FIG. 7 is made of metal and comprises three pieces of plate-like mating contacts 331 arranged substantially in parallel to one another, and a securing member 332 made of an insulating material for securing these mating contacts 331.

Referring again to FIG. 6, the cover 220 is provided with three contact container chambers 221, and each of the contact container chambers 221 comprises a window 222. The mating contacts 331 of the mating connector 330 are electrically connected with the contacts 1 through the windows 222 of this cover 220. Meanwhile, securing grooves 223 are formed inside the contact container chambers 221. The contact 1 is housed in the contact container chamber 221 and the first tab 8 and second tab 9 are press-fitted into the securing grooves 223. Stability of the contact is improved as the tabs 8, 9 joined to the mount 7 are press-fitted and secured to the cover 220. The solder leg 75 of the contact 1 penetrates a hole 230*a* of the circuit board 230 and is connected to the circuit board 230 by soldering. Each of the contacts 1 is secured to the circuit board 230 by soldering the solder leg 75 in a single position. In this way, it is possible to improve productivity in attachment operations.

Next, a third embodiment of the present invention will be described.

Figure 8:
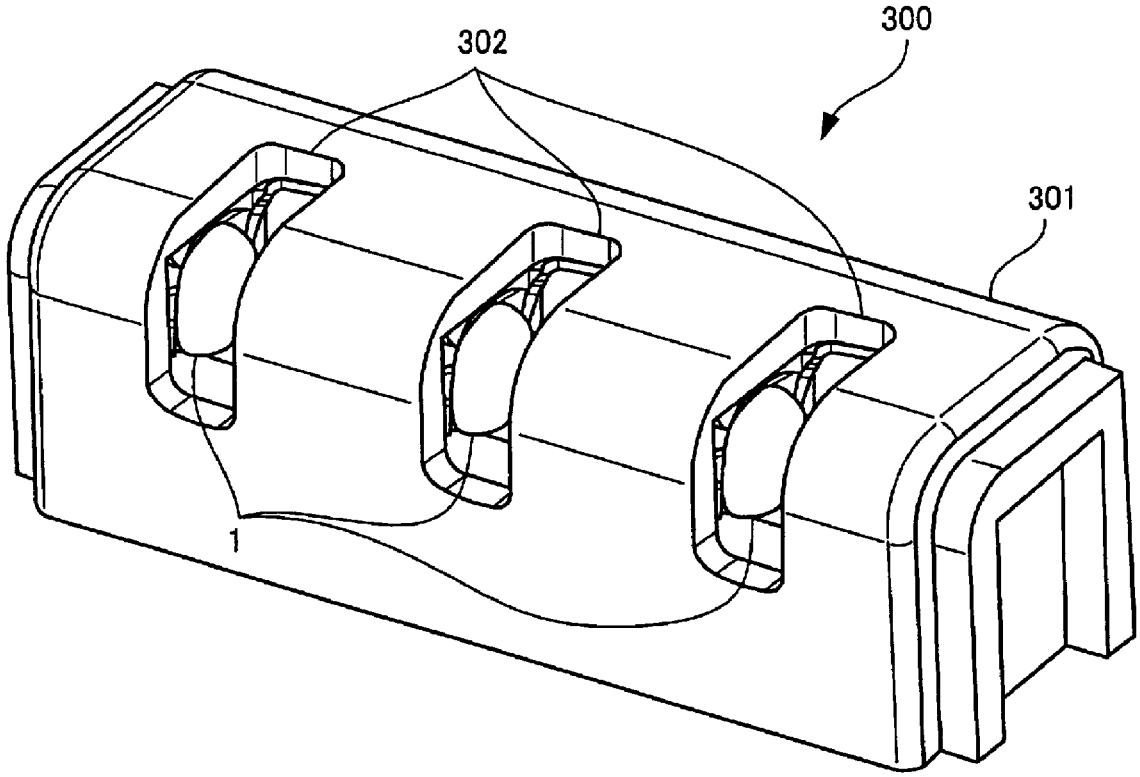
FIG. 8 is a perspective view of a connector according to another embodiment of the present invention.
Figure 9:
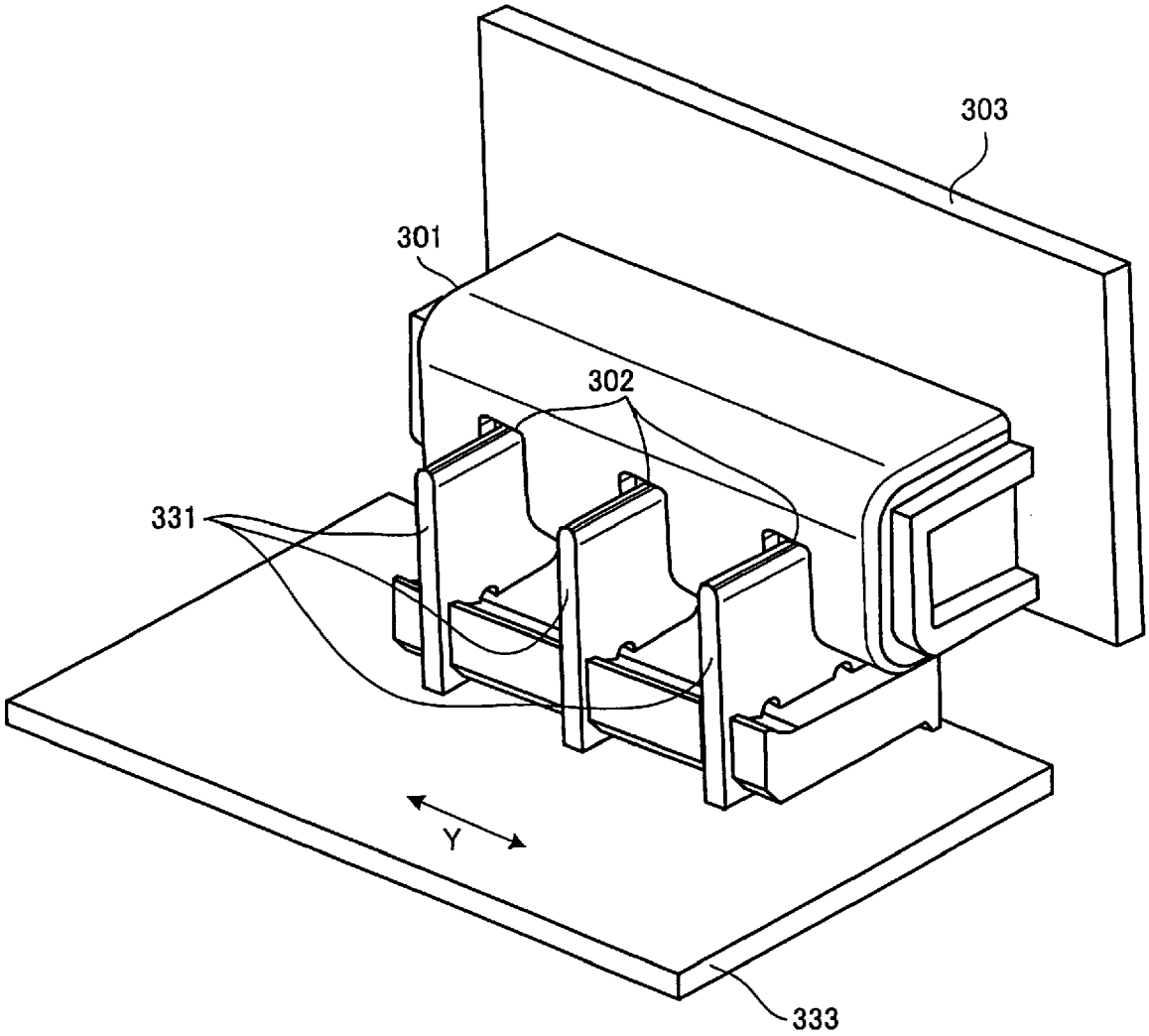
FIG. 9 is a perspective view of the connector of FIG. 8 connected to the mating connector of FIG. 7.

FIG. 8 is a perspective view showing a connector according to the third embodiment of the present invention and FIG. 9 is a view illustrating a connector 300 of FIG. 8 connected to the mating connector 330 shown in FIG. 7. The connector 300 includes three contacts 1, a cover 301, and three windows 302 corresponding to the three contacts 1 that are formed in the cover 301. The three contacts 1 are attached to a circuit board 333.

As shown in FIG. 9, the three contacts 1 of the connector 300 are soldered on and attached to a conducting part of a circuit board 303. Meanwhile, the mating contacts 331 are connected to a circuit board 333 by soldering. When the connector 300 is connected to the mating connector 330, the mating contacts 331 penetrate the windows 302 on the connector 300 and are electrically connected to the contacts 1. In this way, the connector 300 is connected to the mating connector 330. Since the contacts 1 follow the mating contacts 331, the connector 300 remains connected to the mating connector 330 as shown in FIG. 9 even when the mating connector 330 moves in the facing direction Y relative to the connector 300 due to an external force. Accordingly, it is possible to achieve and maintain secure connections. Electrical connection between the connector 300 and the mating connector 330 is maintained even if an impact is applied to the mating connector 330 and the connector 300 by dropping a device containing the connector 300 and the mating connector 330.

The contact 1 described in the first embodiment undergoes additional bending processes other than bending along the lines A, B, D, and E so as to fit in layouts of the circuit board 303 and the cover 301. Next, a contact according to a fourth embodiment will be described by omitting the additional bending processes.

In the following description of the fourth embodiment, the same constituents as those described in the first embodiment will be designated by the same reference numerals, and differences from the first embodiment will be described below.

Figure 10:
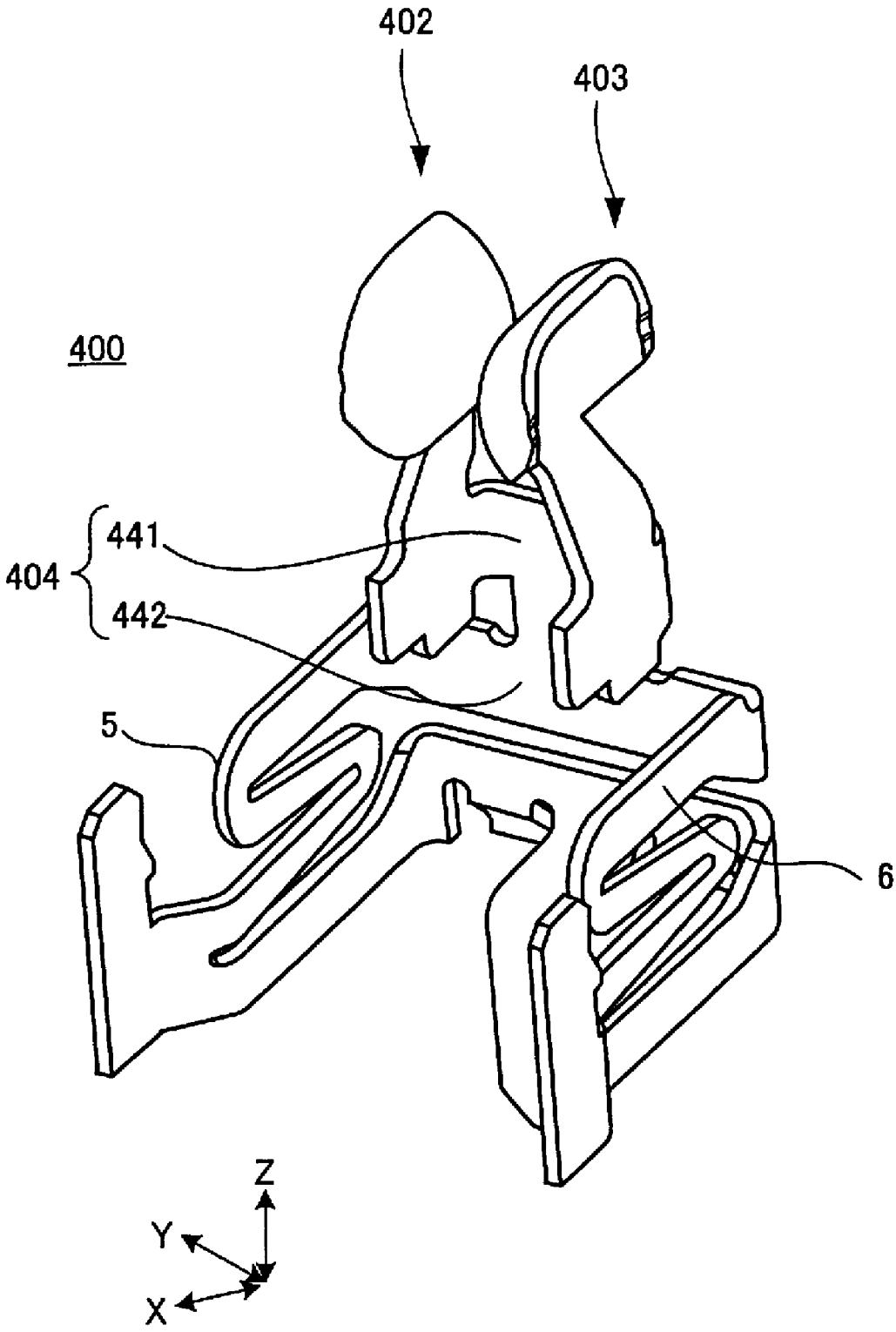
FIG. 10 is a perspective view of a contact according to another embodiment of the present invention.
Figure 11A:
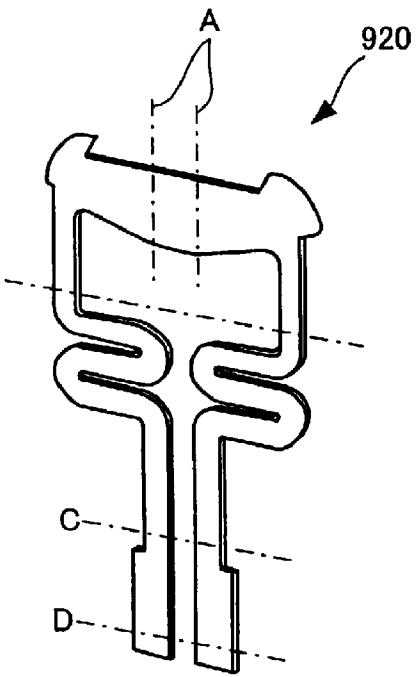
FIG. 11A PRIOR ART
FIG. 11A is a perspective view showing a contact according to a conventional technique before a bending process.
Figure 11B:
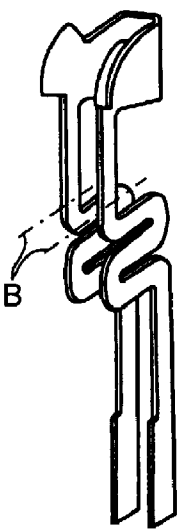
FIG. 11B PRIOR ART
FIG. 11B is a perspective view of the contact of Prior Art FIG. 11A after a first set of bending processes.
Figure 11C:
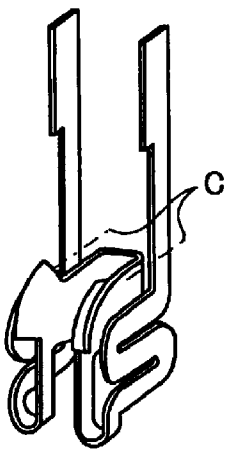
FIG. 11C PRIOR ART
FIG. 11C is a perspective view of the contact of Prior Art FIG. 11B after a subsequent set of bending processes.
Figure 11D:
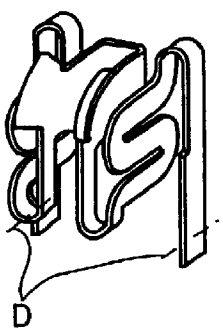
FIG. 11D PRIOR ART
FIG. 11D is a perspective view of the contact of Prior Art FIG. 11C after another subsequent set of bending processes; and Prior Art
Figure 11E:
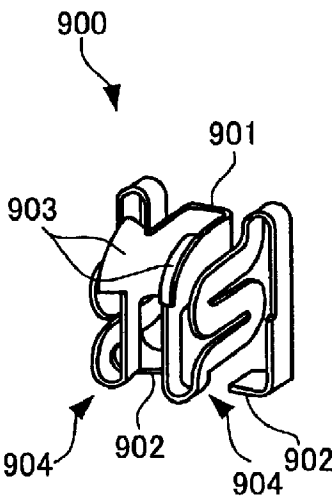
FIG. 11E PRIOR ART
FIG. 11E is a perspective view of the contact of Prior Art FIG. 11D after another subsequent set of bending processes.

FIG. 10 is a perspective view showing appearance of a contact according to the fourth embodiment of the present invention.

A contact 400 shown in FIG. 10 comprises a first arm 402, a second arm 403, and a support 404 similar to the first embodiment. However, in the contact 400, an arm joint 441 and a support plate 442 of a support 404 for supporting the first arm 402 and second arm 403 are not bent and substantially perpendicular to each other but the arm joint 441 and the support plate 442 are instead disposed on the same plane. Moreover, the contact 400 is also different from the contact 1 according to the first embodiment in that the first arm 402 and second arm 403 extend in the vertical direction Z along the support 404. Other features are similar to those of the contact 1 according to the first embodiment. Therefore, the structure to support the first arm 402 and second arm 403 by use of the first spring 5 and second spring 6 which are bent from the support 404 and extend along the planes substantially perpendicular to the facing direction Y can be obtained by bending the contact form 100 shown in FIG. 4A once at an angle of 90° along the line D and once again at an angle of 90° along the line E, similar to the first embodiment. The contact 400 shown in FIG. 10 is manufactured without bending a part corresponding to the line C shown in FIG. 4A.

The contact 1 according to the first embodiment and the contact 400 according to the fourth embodiment also undergo additional bending processes beyond bending along the lines A, B, D, and E to form the first tab 8, the second tab 9, the solder leg 75, the first stop 76, and the second stop 77. However, the contact according to the present invention is not limited only to this. It is also possible to omit any of these additional bending processes for the layouts of the circuit board and the cover.

What is claimed is:

1. A contact, comprising:

a support lying in a first plane and having an arm joint and a support plate, the arm joint and support plate distinguished from each other by a bend with the support plate extending substantially perpendicular to the arm joint;

a first arm supported by the support and configured to contact a mating contact;

a second arm facing the first arm in a facing direction and supported by the support and configured to contact the mating contact;

a first spring and a second spring, each connected to the support and bent in the facing direction and each extending along a second plane substantially perpendicular to the facing direction, the first spring and the second spring elastically supporting the support in the facing direction, the first and second arms being bent from the arm joint of the support and the first and second springs bent from the support plate; and a mount lying in the first plane and connecting the first spring to the second spring;

wherein one set of ends of the first and second springs are connected to the support while the other ends of the first and second springs are connected to the mount.

2. The contact according to claim 1, the mount further comprising:

a solder leg.

3. The contact according to claim 1, wherein each of the first spring and the second spring comprise a meandering shape that lies substantially perpendicular to the facing direction.

4. The contact according to claim 1, further comprising:

a tab integrally formed with the mount.

5. The contact according to claim 1, wherein the mount is configured for attachment to a circuit board.

6. The contact according to claim 1, wherein the first spring and the second spring are connected to opposing ends of the support.

7. The contact according to claim 1, at least one of the first arm and the second arm comprising:

a substantially spherical contour.

8. The contact according to claim 1, where the first arm and the second arm are configured to pinch the mating contact between the first arm and the second arm.

9. The contact according to claim 1, further comprising:

a tab integrally formed with the mount;

wherein the tab is configured for press-fitting into a cover.

10. The contact according to claim 1, wherein each of the first spring and the second spring comprise a meandering S-shape that lies substantially perpendicular to the facing direction.

11. An electrical connector comprising a contact for connection to circuit board and a cover for protecting the contact, the contact comprising:

a support lying in a first plane and having an arm joint and a support plate, the arm joint and support plate distinguished from each other by a bend with the support plate extending substantially perpendicular to the arm joint;

a first arm supported by the support and configured to contact a mating contact;

a second arm facing the first arm in a facing direction and supported by the support and configured to contact the mating contact;

a first spring and a second spring, each connected to the support and bent in the facing direction and each extending along a second plane substantially perpendicular to the facing direction, the first spring and the second spring elastically supporting the support in the facing direction; and a mount lying in the first plane and connecting the first spring to the second spring;

wherein one set of ends of the first and second springs are connected to the support while the other ends of the first and second springs are connected to the mount, the first and second arms being bent from the arm joint of the support and the first and second springs bent from the support plate.

12. The connector according to claim 11, wherein the mount joins the first spring and the second spring and further comprises a solder leg configured for insertion through a hole in the circuit board.

13. The connector according to claim 11, wherein each of the first spring and the second spring comprise a meandering shape that lies substantially perpendicular to the facing direction.

14. The connector according to claim 11, further comprising:

a solder leg integrally formed with the mount, the solder leg being configured for attachment to an electrically conductive portion of the circuit board.

15. The connector according to claim 11, wherein the cover comprises a window associated with the contact.

16. The connector according to claim 15, wherein the window is configured to allow passage of the mating contact therethrough.

17. The connector according to claim 11, at least one of the first arm and the second arm comprising:

a substantially spherical contour that contacts the mating contact.

18. The connector according to claim 11, where the first arm and the second arm are configured to pinch the mating contact between the first arm and the second arm while the mating contact is extended through a window of the cover.

19. The connector according to claim 11, wherein the contact is formed from a substantially flat contact form without bending the contact form by 180°.

20. The connector according to claim 11, wherein the first arm and the second arm extend in substantially the same direction as a tab integrally formed with the mount.

* * * * *